United States Patent [19]

Key et al.

[11] 4,342,340

[45] Aug. 3, 1982

[54] AIR JET LOOM FILLING FEEDING

[75] Inventors: Worth M. Key, Hurt; Wayne Herkness, Salem, both of Va.

[73] Assignee: Burlington Industries, Inc., Greensboro, N.C.

[21] Appl. No.: 158,577

[22] Filed: Jun. 11, 1980

[51] Int. Cl.[3] ..... D03D 47/34

[52] U.S. Cl. ..... 139/435; 139/452; 242/47.01

[58] Field of Search ..... 139/452, 435; 242/47.01–47.11

[56] References Cited

U.S. PATENT DOCUMENTS

| | | | |
|---|---|---|---|
| 2,259,202 | 10/1941 | Cooper | 242/47.01 |
| 3,276,484 | 10/1966 | Bucher | 139/452 |
| 3,470,922 | 10/1969 | Senn | 139/452 |
| 3,904,141 | 9/1975 | Rosen | 139/452 |
| 4,079,759 | 3/1978 | Riha et al. | 139/452 |
| 4,114,822 | 9/1978 | Jocobsson | 242/47.01 |
| 4,118,919 | 10/1978 | Marbacher | 139/452 X |

FOREIGN PATENT DOCUMENTS

| | | | |
|---|---|---|---|
| 429618 | 7/1967 | Switzerland | 139/452 |

*Primary Examiner*—Henry Jaudon

*Attorney, Agent, or Firm*—Cushman, Darby & Cushman

[57] ABSTRACT

A yarn delivery device is provided for textile machines, particularly for air jet looms. A knotcatcher is provided with a measuring drum that reduces frictional drag on the yarn thus reducing the air requirements for pulling the yarn off the drum, reduces the wear on the yarn contact points, has longer life, and is easier to repair than conventional knotcatchers. The knotcatcher includes a circular plate having a circular axially upstanding circular rim, with a plurality of smooth-surfaced hardened steel cylindrical pins upstanding from the rim. The pins are press fit into holes formed in the rim, and if damaged may be readily replaced.

15 Claims, 5 Drawing Figures

A
A
10
10
12
13
14
15
16
18
20
22
24
25
26
27
28
30
31
33
34
40
41
42
50
52

AIR JET LOOM FILLING FEEDING

BACKGROUND AND SUMMARY OF THE INVENTION

The invention relates to a knotcatcher for and a yarn delivery device for textile machines in general, and particularly to an air jet loom utilizing such yarn delivery device. In textile machinery there often is provided a device for measuring a predetermined length of yarn, thread, or the like that is to be fed to other portions of the machine. For instance, air jet looms require a measuring device for measuring the length of yarn necessary for each weft insertion. In such machines, and particularly air jet looms, it is desirable to provide such measuring devices that have no substantial adverse impact on the yarn being measured and delivered thereby, which are easy to construct and repair, and which have long life and use.

Conventional yarn length measurement and delivery devices, particularly for air jet looms, do not always have the desired qualities set forth above. For instance conventional yarn measurement and delivery devices associated with the ELITEX air jet loom manufactured by Investa of Prague, Czechoslovakia have a knotcatcher (also known as a filling snubber wheel) made of an aluminum composition having a plurality of sawtooth teeth extending axially from a circular plate and adapted to move into the yarn path to catch the yarn and cause it to be taken up upon a rotary measuring drum. The sawtooth teeth provide significant resistance to yarn release, requiring a relatively large amount of air pressure to pull the yarn from the measuring drum for a weft insertion. Since the efficiency of the loom, the cost of operating the loom, and the quality of the fabric produced are all greatly affected by the ease in which the yarn is pulled from the filling feeder into the jet, this is undesirable. Additionally, the teeth wear the yarn contact points. Further, replacement of the knotcatchers due to wear is more frequent than desirable, and when a tooth is damaged the knotcatcher must be discarded since there is no adequate mechanism for reattaching the tooth or substituting a new tooth in its place.

According to the present invention, a knotcatcher for and a yarn measurement and delivery device for textile machines, and particularly for use in an air jet loom, is provided that overcomes the problems inherent in prior art devices such as discussed above. In particular, according to the present invention a knotcatcher associated with the yarn delivery device is provided that has minimal resistance to the yarn requiring a minimum amount of air pressure to release the yarn from the knotcatcher and measuring drums. Additionally, the yarn arresting projections formed on the knotcatcher according to the present invention have smooth, curved surfaces so that wear on the yarn at the contact points is reduced. The knotcatcher arresting projections further are constructed so that they may be readily replaced if worn or damaged, and are of hardened steel so that they have a long loom life.

In particular, an exemplary yarn delivery device, for textile machines, according to the present invention includes a stationary housing with a yarn inlet and outlet defining a yarn path, a lipped measuring drum mounted for continuous rotation within the housing, and a knotcatcher mounted for rotation with the measuring drum and for axial movement with respect to the measuring drum from a position within the volume defined by the measuring drum lip to a position axially outwardly past the measuring drum lip into the yarn path, as is conventional. The knotcatcher in accordance with the invention has as its axially extending projections a plurality of smooth-surfaced cylindrical pins. The pins preferably are hardened steel, preferably having a circular cross-section with a diameter of about 1/16 inch and a length of about 0.4 inches. The pins are replaceably mounted in the knotcatcher circular plate. This is preferably accomplished by forming a peripheral circular rim upstanding from one surface of the knotcatcher plate and providing a plurality of through-extending holes in the rim, dimensioned and shaped to receive an end of a pin with a press fit. Preferably 72 pins are disposed around the rim. In order to provide proper balance and weight of the knotcatcher plate (which may be made from an aluminum alloy such as aluminum 6061T6), a plurality of symmetrically shaped, sized, and spaced holes may be formed in the plate within the area defined by the rim.

The yarn delivery device according to the present invention is particularly adapted for use with an air jet loom including an air jet for weft insertion, a confuser channel operatively associated with the air jet, and yarn severing means associated with the confuser channel for cutting off yarn after a weft insertion. Yarn from a supply bobbin supported by appropriate means associated with the loom is fed to the yarn measuring and delivery device according to the invention, the appropriate length is measured thereby, and upon actuation of the air jet the necessary yarn length is inserted into the confuser channel from the delivery device.

It is the primary object of the present invention to provide a yarn delivery device for textile machines having a knotcatcher effecting minimum wear of the yarn, having minimal resistance to yarn removal, and having long loom life. This and other objects of the invention will become clear from an inspection of the detailed description of the invention, and from the appended claims.

DETAILED DESCRIPTION OF THE DRAWINGS

Figures 1, 2:
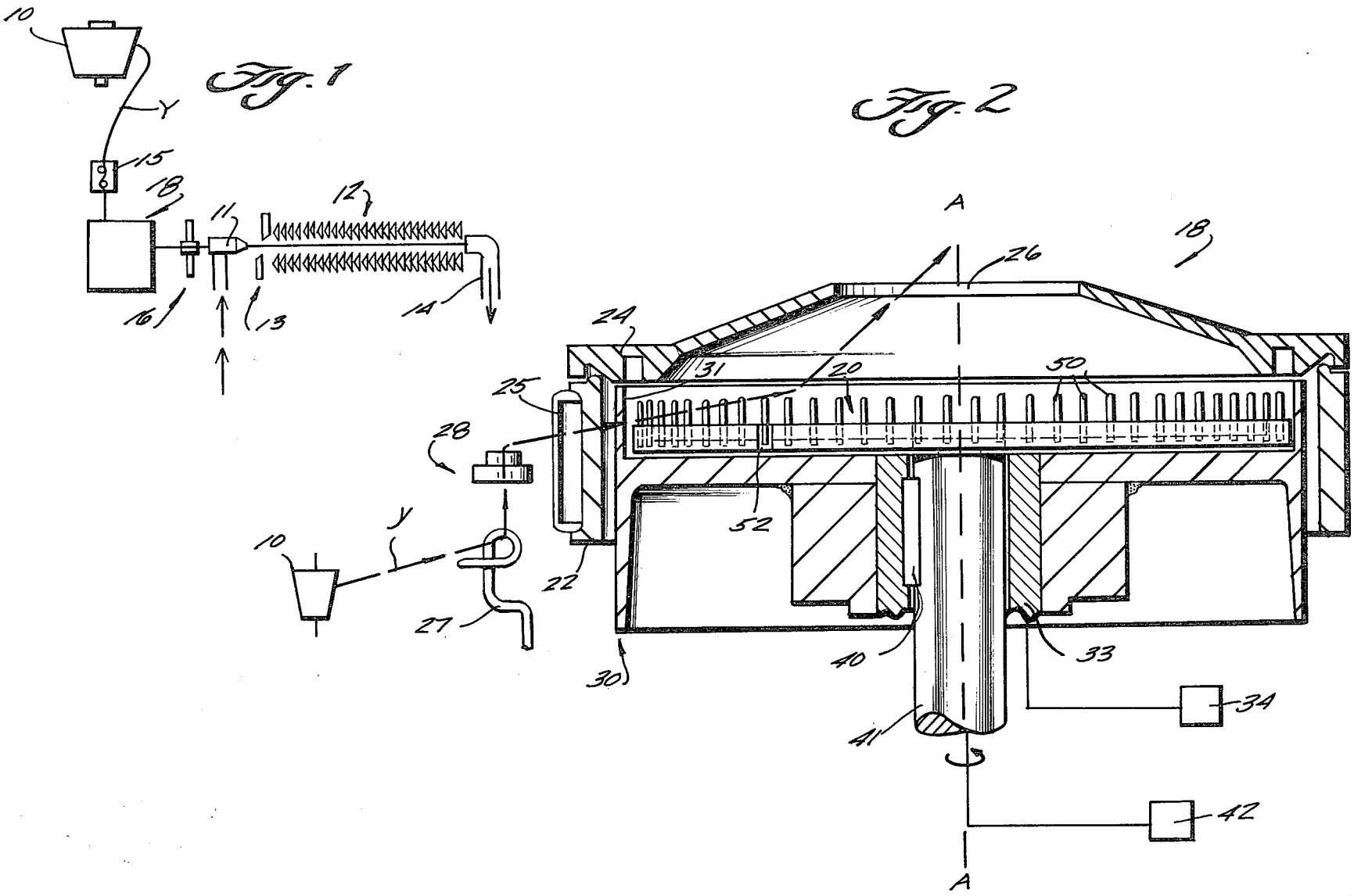
FIG. 1 is a schematic view of an exemplary air jet loom utilizing a yarn measurement and delivery device according to the invention.
FIG. 2 is an actual size side view, partly in cross-section and partly in elevation, of an exemplary yarn measurement and delivery device according to the present invention shown in the release position thereof.

A conventional air jet loom is illustrated schematically in FIG. 1 and includes means for supporting a cross-wound bobbin 10 of yarn Y, an air jet 11, a confuser channel 12, and yarn severing means 13 associated with the confuser channel 12 for cutting off the yarn Y after a weft insertion. Additionally, a source of suction 14 is provided to increase the insertion efficiency of the weft, a braking device 15 is provided, and clips 16 are utilized to secure the yarn end to prevent runout from the air jet 11. According to the present invention an improved yarn delivery and measuring device 18 is provided between the braking device 15 and the clips 16 for measuring the necessary length of yarn Y for a weft insertion from the bobbin 10, and providing for delivery thereof to the air jet 11 when the air jet is actuated from a conventional control source. An exemplary conventional air jet loom with which the device 18 according to the present invention is particularly useful is the ELITEX air jet loom manufactured by Investa of Prague, Czechoslovakia.

Figure 3:
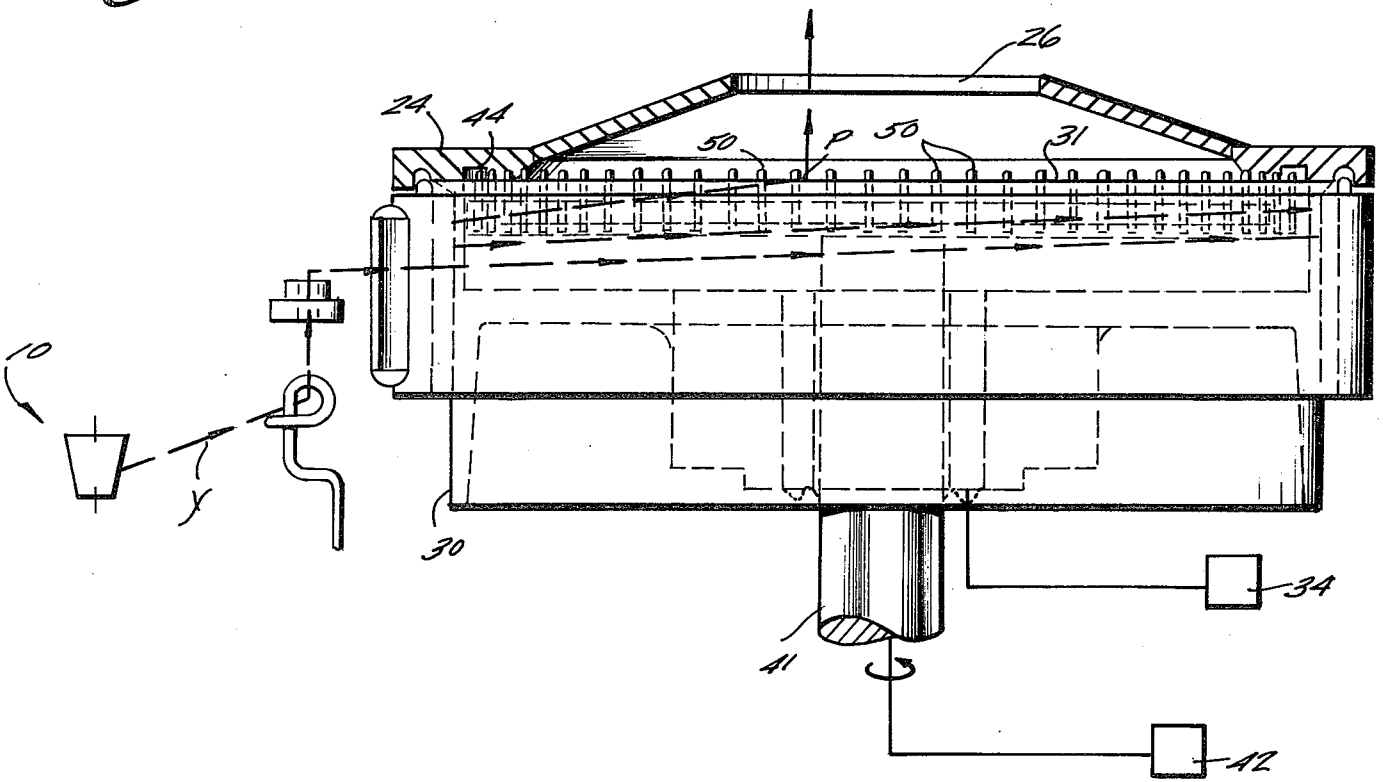
FIG. 3 is a side view from the same perspective as FIG. 2 only illustrating the yarn delivery device in yarn arresting position.
Figure 4:
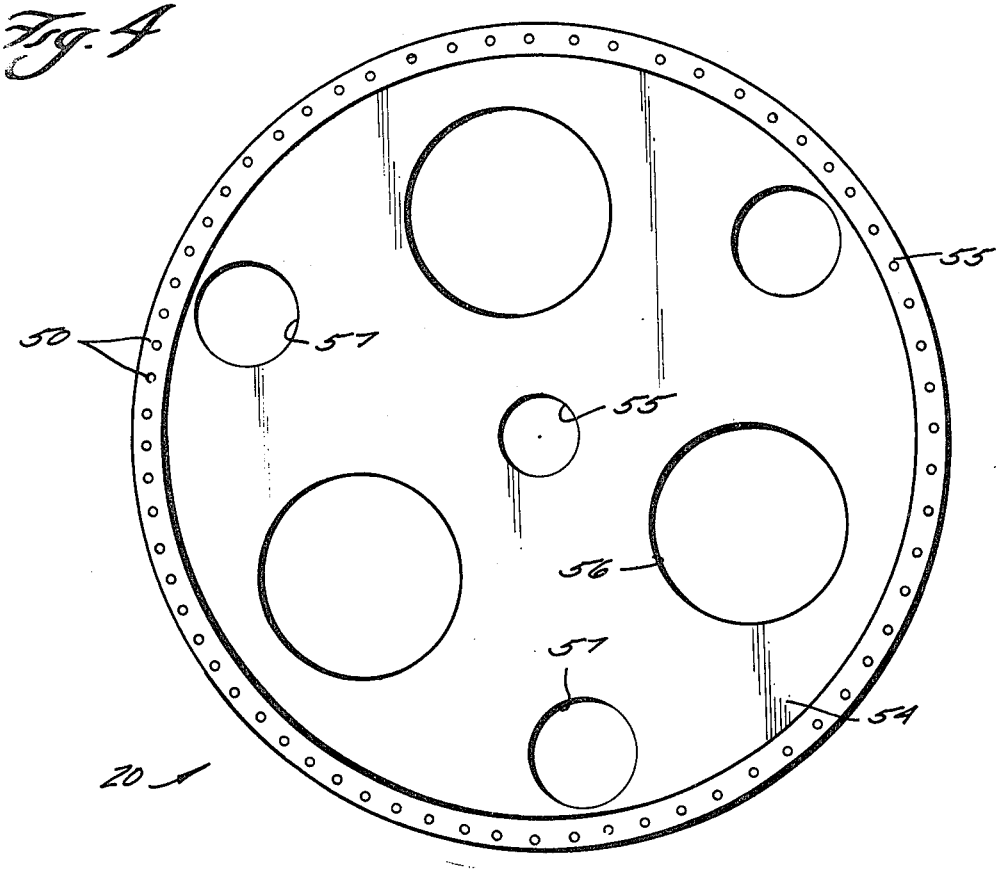
FIG. 4 is a top plan view of the knotcatcher illustrated in FIGS. 2 and 3.

An exemplary device 18 according to the present invention is illustrated in actual scale in FIGS. 2 and 3, and the knotcatcher (also known as a filling snubber wheel) 20 according to the present invention utilized in the device 18 is also illustrated in actual scale in FIG. 4.

The device 18 includes, as is conventional, a stationary housing including a drum cover 22 and a drum cover face 24. The housing includes a yarn inlet and a yarn outlet, the yarn Y traveling in a predetermined yarn path (as illustrated in FIG. 2) from the inlet to the outlet. The inlet is preferably defined by a yarn entry slot 25 formed in the drum cover 22 and the yarn outlet is defined by the central opening 26 in drum cover face 24. Yarn is fed from bobbin 10 through yarn guide 27 and yarn guide tube 28 to inlet slot 25.

The yarn measuring and delivering device 18 further conventionally comprises a measuring drum 30 including a lip 31 which is spaced from the housing portion 24 so that the yarn Y may pass past the lip 31 from inlet 25 to outlet 26, as illustrated in FIG. 2. The drum 30 is continuously rotated about axis A—A (which normally is horizontally disposed in use) due to its connection to shaft 33 which is rotated by a conventional power source 34 (e.g. an electric motor powered belt and pulley arrangement).

Figure 5:
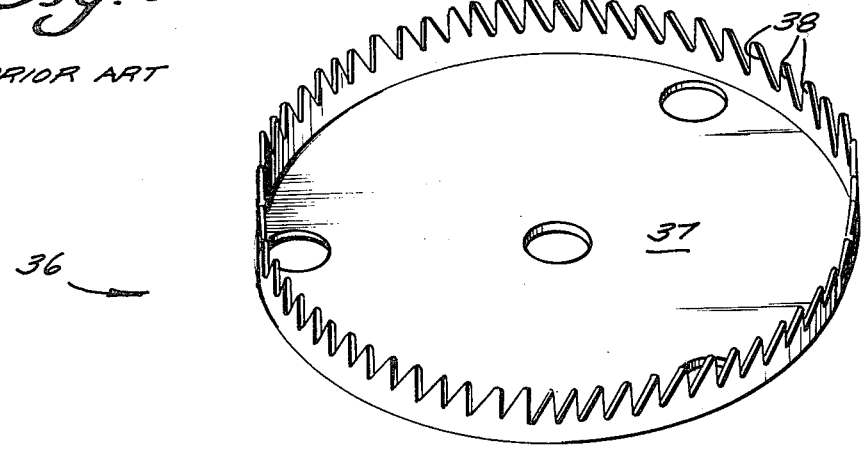
Fig. 5 PRIOR ART
FIG. 5 is a perspective view of an exemplary prior art knotcatcher, over which the present invention is an improvement.

Conventionally, a knotcatcher such as illustrated at 36 in FIG. 5, is associated with the device 18. The device 36 comprises an integral structure including circular plate 37 and upstanding sawteeth 38, all formed of an aluminum alloy. The knotcatcher is mounted for rotation with the drum 30, and for axial movement along axis A—A with respect to the drum 30. This may be accomplished by providing a spline connection 40 between rod 41 (which is bolted to the knotcatcher) and shaft 33, with the rod 41 axially moved by a conventional structure 42 (such as a cam and lever arrangement). The knotcatcher is movable from a position wherein the axially extending projections thereof are contained within the volume defined by the drum lip 31 (see FIG. 2) so that the yarn path from inlet 25 to outlet 26 is not interrupted, to a second position wherein the projections interrupt the yarn path (see FIG. 3) so that the yarn catches on one of the projections and is taken up from bobbin 10 on the rotating measuring drum 30 (see FIG. 3). A circular channel 44 is defined in housing portion 24 into which the projections extend in this position, again as illustrated in FIG. 3.

According to the present invention, the knotcatcher 20 is provided in the device 18. The knotcatcher 20 has as its upstanding projections a plurality (e.g. 72) of equally spaced smooth-surfaced cylindrical pins 50. The smooth, arcuate configuration of the pins 50 results in minimal wear on the yarn Y at the yarn contact points (see point P in FIG. 3) and provides minimal resistance to the releasing force provided by the air jet 11 when it is desired to take the measured length of yarn off of the drum 30, the yarn being removed generally along axis A—A (see FIGS. 2 and 3). For increased loom life and in order to provide the desired smooth surface, the pins 50 preferably are constructed of hardened steel.

According to the present invention, a plurality of surface manifestations are formed in the plate 54, and means are provided for replaceably mounting the pins in association with the surface manifestations. Preferably, the surface manifestations comprise means defining a plurality of through-extending holes 52 (see FIG. 2) which are dimensioned and shaped to receive an end of a pin 50 with a press fit. In one operative embodiment according to the present invention, the pins 50 have a circular cross-section with a diameter of about 1/16 inch and are about 0.4 inches long, the holes 52 having a substantially corresponding diameter.

The knotcatcher 20 also comprises circular plate 54 which supports pins 50. The plate 54 has a circular rim 55 axially upstanding along the periphery of one face thereof, and the openings 52 are formed in the rim 55. The plate 54, with integral rim 55, may be formed of an aluminum alloy, such as aluminum 6061T6. In an operative environment according to the invention with the pins 50 mounted in the openings 52, they extend upwardly from the rim 55 a uniform distance of about 0.2 to 0.3 inches.

The plate 54 includes a central opening 55 through which a bolt passes to attach the plate 54 to the rod 41. Additionally, since the balance and weight of the knotcatcher 20 are extremely important, a plurality of symmetrically shaped and sized and spaced holes 56, 57 may be formed within the area defined by the rim 55 for reducing the mass of the plate (see FIG. 4).

In operation of the device according to the present invention, yarn is fed from bobbin 10 through braking device 15 in a yarn path through yarn guides 27 and 28 through housing inlet 25 to housing outlet 26, and ultimately through clips 16 to air jet 11. Before an actuation of air jet 11 the mechanism 42 moves rod 41 from the position illustrated in FIG. 1 to the position illustrated in FIG. 2 wherein the tips of pins 50 extend axially outward from the lip 31 of measuring drum 30, intersecting the yarn path of yarn Y. During this time the drum 30 and yarn catcher 20 are continuously being rotated by mechanism 34.

With the pins 50 in the position illustrated in FIG. 3, the yarn Y will immediately be caught by one of the pins, as at point P. This arresting of the yarn will cause the yarn to be taken up on the rotating measuring drum 30, as illustrated in FIG. 3. The length of yarn wound onto the drum 30 is determined by the speed of rotation of the drum 30 as determined by mechanism 34, and the timing of the outward and inward movement of the knotcatcher 20 as determined by the device 42, the operation of the device 42 being synchronized with the operation of air jet 11.

Once the desired length of yarn has been wound up on measuring drum 30, the air jet 11 is actuated, pulling the yarn Y from the drum 30 and pins 50 and inserting it into confuser channel 12. After insertion cutters 13 are actuated to cut off the weft, and clips 16 are actuated to hold the yarn end in the jet 11 to prevent reverse movement therefrom. The movement of the knotcatcher 20 from the position illustrated in FIG. 3 to the position illustrated in FIG. 2 is also timed with the actuation of jet 11 so that as jet 11 is actuated this movement is initiated.

Should a pin 50 break, it is only necessary to stop operation of the device 18, remove knotcatcher 20, punch out any portion of the pin 50 still received by an opening 52 in rim 55, and insert a new pin 50.

It will thus be seen that according to the present invention an improved knotcatcher in a yarn delivery device for textile machines, particularly air jet looms, has been provided. While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A yarn delivery device for textile machines, comprising a stationary housing;

a yarn inlet to said housing and a yarn outlet from said housing, yarn traveling from said inlet to outlet in a yarn path;

a measuring drum mounted for continuous rotation within said housing about an axis of rotation, said measuring drum having a lip, spaced from said housing, past which yarn in the yarn path passes;

a filling snubber wheel mounted for rotation with said measuring drum and having a plurality of axially-extending projections, and mounted for axial movement with respect to said measuring drum from a first position wherein said yarn-catching projections are contained within a volume defined by said measuring drum lip, to a second position wherein said yarn-catching projections extend axially outwardly past said measuring drum lip into said yarn path so that one of said projections will catch yarn in said yarn path and cause the yarn to be taken up on said rotating measuring drum; wherein the improvement comprises:

said filling snubber wheel projections comprising a plurality of smooth-surfaced cylindrical pins; and said device further comprising a plurality of surface manifestations formed in said filling snubber wheel, and means for replaceably mounting said pins in association with said surface manifestations; and wherein said filling snubber wheel comprises a circular plate having a circular rim axially upstanding along the periphery of one face thereof, and wherein said surface manifestations are formed in said rim and said pins axially upstanding from said rim.

2. A device as recited in claim 1 wherein said pins are hardened steel pins.

3. A loom as recited in claim 2 wherein said knotcatcher comprises a circular plate having a circular rim axially upstanding along the periphery of one face thereof, said means defining said holes in said knotcatcher defining said holes in said rim.

4. A device as recited in claims 1 or 2 wherein said filling snubber wheel surface manifestations comprise means defining a plurality of axial holes in the filling snubber wheel, and wherein said means for replaceably mounting said pins in said holes comprise end portions of said pins dimensioned and shaped to be received by said holes.

5. A device as recited in claim 4 wherein said pin end portions are dimensioned and shaped to provide a press fit with said holes.

6. A device as recited in claims 1 or 2 wherein said pins are circular in cross-section with a diameter of about 1/16 inch.

7. A device as recited in claim 1 wherein said plate has means defining a plurality of symmetrically shaped and sized, and symmetrically spaced, holes therein within the area defined by said rim, for reducing the mass of said plate.

8. A yarn delivery device for textile machines, comprising a stationary housing;

a yarn inlet to said housing and a yarn outlet from said housing, yarn traveling from said inlet to outlet in a yarn path;

a measuring drum mounted for continuous rotation within said housing about an axis of rotation, said measuring drum having a lip, spaced from said housing, past which yarn in the yarn path passes;

a filling snubber sheel mounted for rotation with said measuring drum and having a plurality of axially-extending projections, and mounted for axial movement with respect to said measuring drum from a first position wherein said yarn-catching projections are contained within a volume defined by said measuring drum lip, to a second position wherein said yarn-catching projections extend axially outwardly past said measuring drum lip into said yarn path so that one of said projections will catch yarn in said yarn path and cause the yarn to be taken up on said rotating measuring drum; wherein the improvement comprises:

said filling snubber wheel projections comprising a plurality of smooth-surfaced cylindrical pins; that are circular in cross-section with a diameter of about 1/16 inch and said device further comprising a plurality of surface manifestations formed in said filling snubber wheel, and means for replaceably mounting said pins in association with said surface manifestations.

9. A device as recited in claim 8 wherein said pins have a length of about 0.4 inch, and there are 72 pins.

10. An air jet loom comprising:

an air jet for weft insertion;

a confuser channel operatively associated with said air jet;

yarn severing means associated with said confuser channel for cutting off the yarn after a weft insertion;

means for supporting a supply of yarn; and means for measuring the length of yarn necessary for an insertion, said measuring means being supplied with yarn from a supply supported by said supply supporting means, and for delivering the yarn to said air jet; said measuring means comprising: a stationary housing; a yarn inlet to said housing and a yarn outlet from said housing, yarn traveling from said inlet to outlet in a yarn path; a measuring drum mounted for continuous rotation within said housing about an axis of rotation, said measuring drum having a lip, spaced from said housing, past which yarn in the yarn path passes; a filling snubber wheel mounted for rotation with said measuring drum and having a plurality of axially-extending projections, and mounted for axial movement with respect to said measuring drum from a first position wherein said yarn-catching projections are contained within a volume defined by said measuring drum lip, to a second position wherein said yarn-catching projections extend axially outwardly past said measuring drum lip into said yarn path so that one of said projections will catch yarn in said yarn path and cause the yarn to be taken up on said rotating measuring drum, said filling snubber wheel comprising a circular plate having a circular rim axially upstanding along the periphery of one face thereof; said projections comprising a plurality of smooth-surfaced cylindrical pins; means defining a plurality of axially-extending holes in said filling snubber wheel rim; and means for replaceably mounting said pins in said holes.

11. A loom as recited in claim 10 wherein said pins are hardened steel pins.

12. A filling snubber wheel for a yarn delivery device for textile machines, comprising: a circular plate; a circular rim axially upstanding along the periphery of one face of said plate; a plurality of smooth-surfaced cylindrical pins; and means defining a plurality of holes in said circular rim for replaceably receiving one end of said cylindrical pins so that said pins extend perpendicularly outwardly from said plate and are symmetrically disposed around said rim.

13. A filling snubber wheel as recited in claim 12 wherein said pins are hardened steel pins.

14. A filling snubber wheel as recited in claim 13 wherein each of said pins has a circular cross-section with a diameter of about 1/16 inch, and upstands from said rim a uniform distance of 0.2–0.3 inches.

15. A yarn delivery device for textile machines, comprising:

a stationary housing;

a yarn inlet to said housing and a yarn outlet from said housing, yarn traveling from said inlet to said outlet in a yarn path;

a measuring drum mounted for continuous rotation within said housing about an axis of rotation, said measuring drum having a lip, spaced from said housing, past which yarn in the yarn path passes;

a filling snubber wheel comprising a circular plate having a circular rim axially upstanding along the periphery of one face thereof, and mounted for rotation with said measuring drum and having a plurality of axially-extending smooth surfaced cylindrical pins, and mounted for axial movement with respect to said measuring drum from a first position wherein said yarn-catching projections are contained within a volume defined by said measuring drum lip, to a second position wherein said yarn-catching projections extend axially outwardly past said measuring drum lip into said yarn path so that one of said projections will catch yarn in said yarn path and cause the yarn to be taken up on said rotating measuring drum;

means defining a plurality of axial holes in said filler snubber wheel; and means for replaceably mounting said pins in said holes, comprising end portions of said pins dimensioned and shaped to be received by said holes.

* * * * *